US005485896A

United States Patent [19]

Kowalczyk et al.

[11] Patent Number: 5,485,896

[45] Date of Patent: Jan. 23, 1996

[54] ROTARY ELEVATOR CAR DOOR COUPLING

[75] Inventors: Thomas M. Kowalczyk; Thomas M. McHugh, both of Farmington; Edward E. Ahigian, West Hartford; Jerome F. Jaminet, South Windsor; Thomas He, Unionville; Richard E. Peruggi, Glastonbury; Richard E. Kulak, Bristol; David W. Barrett, East Hartland, all of Conn.

[73] Assignee: Otis Elevator Company, Farmington, Conn.

[21] Appl. No.: 223,926

[22] Filed: Apr. 6, 1994

[51] Int. Cl.[6] ..... B66B 13/12

[52] U.S. Cl. ..... 187/330; 49/120

[58] Field of Search ..... 187/319, 330; 49/120, 122

[56] References Cited

U.S. PATENT DOCUMENTS 2,432,293 12/1947 Giovanni ..... 187/319

2,626,018 1/1953 Healey ..... 187/330

*Primary Examiner*—Kenneth Noland

[57] ABSTRACT

A horizontally stiff, but vertically yielding coupling between an elevator car door and an elevator hoistway door includes a brushless torque actuator which rotates a member (disposed on the elevator door) between a first, clearance position and a second, coupling position where it becomes wedged between the walls of a channel disposed on a hoistway door. The member may have rollers to make contact with the walls of the channel, or it may simply have sliding surfaces for contact with the channel.

4 Claims, 1 Drawing Sheet

ROTARY ELEVATOR CAR DOOR COUPLING

TECHNICAL FIELD

This invention relates to positively coupling the hoistway doors of an elevator to the elevator car doors so that the hoistway doors can be driven open and driven closed, positively, in unison with and by the motion of the elevator car doors as they are driven open and driven closed by a door operating mechanism.

BACKGROUND ART

Modern elevator systems have doors to permit transfer of passengers between the elevator cars and the respective floor landings. Because smaller doors have to travel a lesser distance and have less inertia, many elevators have two doors. They may meet in the middle, and thereby have a lesser distance to travel or they may both travel to the same side for opening. Other elevators may have only a single door. As used herein, the term "door" or "doors" may be used interchangeably, it being understood that there is no distinction between a single door and double doors concerning the subject matter hereof.

Present day elevator systems have doors mounted on the elevator car, and doors mounted at each hall landing of the elevator hoistway. The hoistway doors at the hall landings are mounted directly to the building structure, and are kept closed whenever the car is not present at the related landing in order to prevent passengers and objects from entering the hoistway. Instead of having door operators for each of the hoistway doors, the hoistway doors are typically opened by coupling them with the car doors, so that opening of the car doors will open the landing doors in unison therewith, thereby protecting passengers in the car from the building structure and protecting passengers at the landing from the hoistway.

The manner of coupling the doors together must take into account several factors. The doors usually begin to open just before the car reaches the landing (such as 10 or 15 centimeters therefrom), resulting in relative vertical motion between the elevator door and the hoistway door as the elevator approaches the landing. A similar constraint is that the car may be releveled after the doors are open, which also requires permissible relative vertical motion between the car doors and the hoistway doors. The hoistway doors may easily be pushed open by the elevator doors, but they must also become closed, either by being pulled (or pushed) toward the closed position by the elevator doors, or by some biasing in the closed direction. Biasing in the closed direction may take the form of a spring, a weight or aspirator. However, any bias in the closed direction must be overcome by the force exerted by the elevator doors during the opening process. Similarly, any perturbations in the bias during the opening process will in turn provide perturbation in the control algorithm for the elevator door opening system. Therefore, it is deemed preferable to have the hoistway doors opened and closed by the elevator doors, without separate bias.

A typical coupling device employs a rigid vane mounted on the car door which engages a rotatable pawl from the hoistway door, the pawl having rollers thereon so that the vane can travel upwardly or downwardly while engaging the pawl. Typically, there may be some lost motion between the two doors; that is, the car door must begin to open before it engages the pawl, unlocking the hoistway door, and commencing to push the hoistway door, through the pawl, in the open direction. When closing, this requires an additional mechanism to be sure that the hoistway doors are fully latched before the car door motion stops (before the car doors are fully closed). In some assemblies, the rollers move into contact with the vane before motion, and in others, the vane is expanded to contact the rollers before any motion. However, devices of this type are wear and adjustment sensitive and require frequent adjustments and replacements over the life span of an elevator system.

Whenever there is a change in the amount of force required to move an elevator car door, either because of lost motion between it and a hoistway door, or because of a change in the mechanism leverage and the like, perturbations of the electrical control system which is providing the motive force for the car door opening mechanism can result. This in turn can cause vibrations and other mechanical perturbations thus resulting in additional wear and noise. In fact, for door control mechanisms which have closed velocity loop electrical control systems, horizontally stiff coupling is required throughout the full range of door motion. For door couplings which have lost motion, that is, the two door sets are de-coupled during some range (between 1 and 3 centimeters) of car door motion, the hoistway doors must rely on a weight closer (or other biasing device) to fully close the hall doors. And, in very tall buildings, door closing (particularly at the lobby) can be erratic due to hoistway air pressure (called "windage" or "chimney effect"), unless the hoistway doors are closed positively.

Another desired feature is that the edges of the hoistway doors be flush with the edges of the car doors, as a consequence of being opened completely in unison.

Of course, any coupling mechanism located on a particular hoistway door must have complete clearance, for all of the apparatus, including the corresponding parts of a coupling device which are mounted on the car doors, so that elevators that are simply passing by landings do not run the risk of contact with the hoistway door coupling devices.

DISCLOSURE OF INVENTION

Objects of the invention include provision of a horizontally stiff coupling between an elevator car door and a hoistway door which, however, allows relative vertical motion between the car door and the hall door when coupled, and which provides the coupling throughout the full range of door motion.

According to the present invention, a device mounted on an elevator car door can be rotated into a first position in which there is clearance between it and the sidewalls of a vertical channel member disposed on a hoistway door to which the elevator door is to become coupled, the device being rotatable into a second position which is nearly orthogonal to the first position and in which it is wedged tightly to the inner surfaces of the channel walls. The device may be rotated by a brushless torque actuator. The rotatable device may comprise an arm with two rollers disposed at ends thereof, the rollers making contact with and causing the wedging action to the channel walls. Or, a lobed cam may be used to permit rotation between a first position where there is clearance between it and the interior of the channel walls and a second position nearly orthogonal therewith where the lobed cam becomes wedged between the interior surfaces of the channel walls.

The device in accordance with the present invention is simple, very reliable, and requires little or no adjustment due to wear over significant periods of time. The coupling is absolute across the entire range of door motion.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
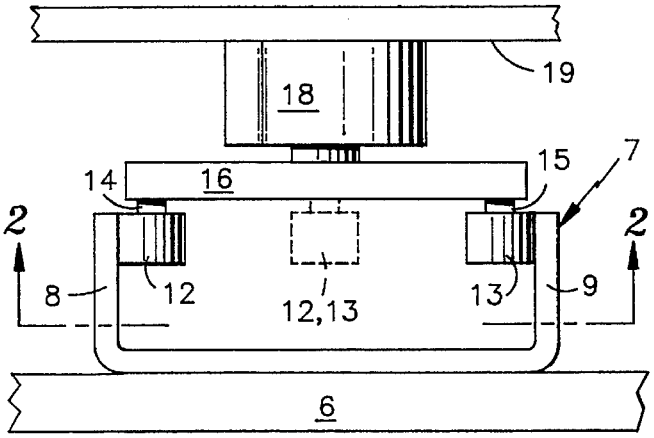
FIG. 1 is a bottom plan view of an elevator car door coupling according to the present invention.

Referring now to FIG. 1, an elevator hoistway door 6 has a channel 7 disposed thereon and secured thereto in any suitable fashion such as by machine screws, spot welding or other bonding (not shown). The channel 7 has two parallel vertical sidewalls 8, 9 extending into the hoistway. A pair of rollers 12, 13 are rotatively disposed by pins 14, 15 to a rotatable member, such as an arm 16, which is connected, such as by means of a screw 17 (FIG. 2) to an actuator, which may be a brushless torque actuator 18, such as the BTA series of Lucas Ledex, Inc., Bengalia, Ohio, USA, which have long life. The actuator 18 is disposed to an elevator car door 19 in any suitable fashion.

Figure 2:
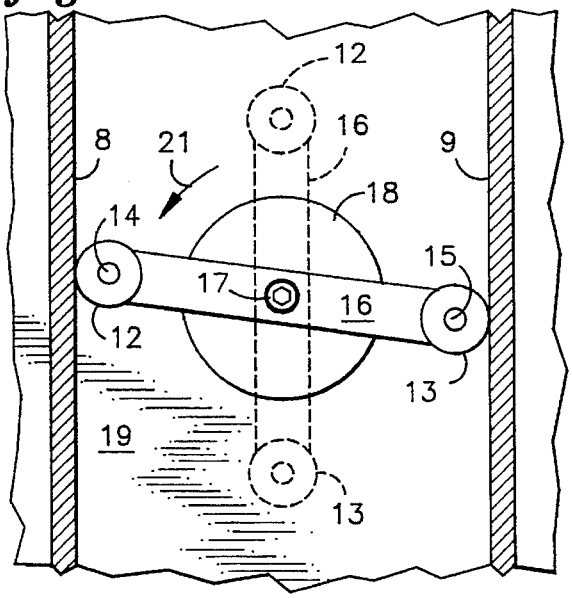
FIG. 2 is a partial, side elevation, sectional view taken on the line 2—2 of FIG. 1.

When the elevator is, or is about to be, moving, the arm 16 is in the position shown in dotted lines, thereby providing adequate clearance between it and the interior surfaces of the channel walls 8, 9. As the elevator approaches sufficiently close to a landing so that advance door opening may begin, the rotary actuator 18 will rotate the arm 16 in the direction shown by the arrow 21 until the arm 16 reaches the position shown in solid lines, in which the rollers 12 and 13 are wedged between the walls 8, 9. As the elevator continues to travel a short distance to the landing, the rollers 12, 13 allow vertical motion between the two doors. On the other hand, with the rollers 12, 13 wedged between the walls 8, 9 as shown in FIG. 2, there is horizontal stiffness in the coupling between the hoistway door 6 and the elevator door 19, whereby motion of the elevator door 19 will carry the hoistway door 6 along with it. Similarly, even with the doors fully open, releveling may be achieved by virtue of the relative vertical motion permitted between the rollers 12, 13 and the channel walls 8, 9. After transferring passengers, when the doors are fully closed, the actuator 18 rotates the arm 16 into the clearance position, shown solid in FIG. 2.

Figure 3:
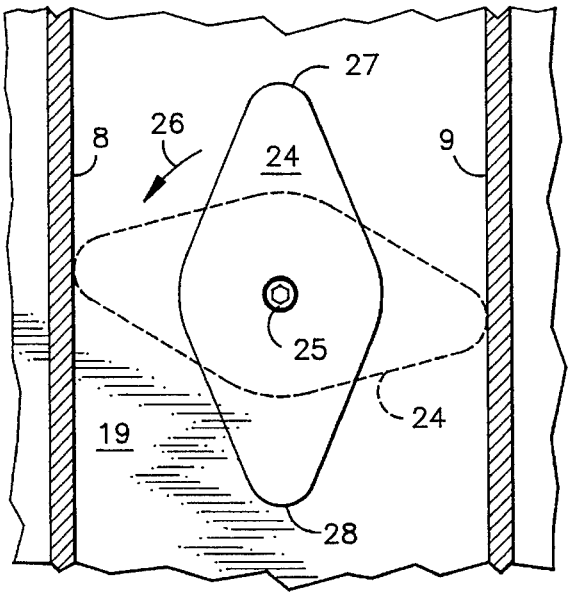
FIG. 3 is a side sectional view of an alternative to the embodiment of FIGS. 1 and 2.

An alternative form of the invention is illustrated in FIG. 3. Therein, the member comprises a simple, lobed cam 24 which may be secured to the actuator (such as the actuator 18, not shown) by means of a screw 25. When in the position shown in solid lines, there is adequate clearance between the lobed cam 24 and the interior surfaces of the channel walls 8, 9 so as to permit the elevator to travel past a landing without the lobed cam 24 contacting the channel walls 8, 9. When actuated, the actuator will rotate the lobed cam 24 in the direction of the arrow 26 to cause the lobes 27, 28 of the lobed cam 24 to become wedged between the interior surfaces of the channel walls 8, 9 in the same fashion as the rollers 12, 13 of FIG. 2. For relative vertical motion between the doors 6, 19 (FIG. 1), the lobes 27, 28 simply slide along the internal surfaces of the channel walls 8, 9.

Numerous other variations to provide wedging with rolling or sliding when required, between a structure on the hoistway door and a structure on the elevator door, may be used to embody the rotatable member having a first position in which its narrow width provides clearance between the structures of the hoistway door and the elevator door, and a second position, substantially orthogonal to the first position, in which its length allows it to be wedged between the surfaces of a structure disposed on the other door.

The brushless torque actuator 18 and the rotatable member arm 16 or lobed cam 24 are disposed on the elevator door so as to be available for use at each landing, whereas only a simple channel is required on the hoistway door of each of the landings.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Apparatus for coupling an elevator hoistway door to an elevator car door so that the two may be operated in unison, comprising:

a pair of parallel vertical walls extending outwardly into the hoistway from a surface of a hoistway door;

a member having a length dimension which is slightly greater than the distance between the mutually facing surfaces of said walls and having a width dimension essentially orthogonal to said length dimension which is significantly less than the distance between said surfaces, said member disposed for rotation adjacent a surface of the elevator car door facing the landing side of the elevator hoistway in a position, when at a landing, to be between said surfaces; and an actuator for rotating said member from an uncoupled position, in which the length of said member is parallel to said walls, into a coupling position in which the length of said member is substantially orthogonal to and wedged between said walls, thereby to provide horizontally rigid coupling between the elevator car door and the hoistway door throughout the full range of travel.

2. Apparatus according to claim 1 wherein said member includes a roller disposed at each end thereof, said rollers coming in contact with the facing surfaces of said walls when said member is rotated into the coupling position.

3. Apparatus according to claim 1 wherein said member comprises a lobed cam, the lobes of which contact the facing surfaces of said walls when said member is rotated into the coupling position.

4. Apparatus according to claim 1 wherein said actuator comprises a brushless torque actuator.

* * * * *